US006185400B1

(12) United States Patent
Sanchez et al.

(10) Patent No.: US 6,185,400 B1
(45) Date of Patent: Feb. 6, 2001

(54) TONER CARTRIDGE HAVING A PLANAR DISCHARGING MEMBER

(75) Inventors: Ismael R. Sanchez, Pittsford, NY (US); Roberto Carlos C. Dibo, Amazonas (BR)

(73) Assignee: Xerox Corporation, Stamford, CT (US)

( * ) Notice: Under 35 U.S.C. 154(b), the term of this patent shall be extended for 0 days.

(21) Appl. No.: 09/340,562

(22) Filed: Jun. 28, 1999

(51) Int. Cl.[7] ..... G03G 15/08
(52) U.S. Cl. ..... 399/260; 399/281
(58) Field of Search ..... 399/106, 258–260, 399/262, 263, 272, 281; 222/DIG. 1

(56) References Cited

U.S. PATENT DOCUMENTS

| | | | | |
|---|---|---|---|---|
| 4,647,180 | * | 3/1987 | Watanabe | 399/258 |
| 4,993,829 | | 2/1991 | Naganuma et al. | 399/260 |
| 5,012,289 | * | 4/1991 | Aldrich et al. | 399/260 |
| 5,101,237 | * | 3/1992 | Molloy | 399/260 |
| 5,640,651 | * | 6/1997 | Katoh et al. | 399/281 |
| 5,686,985 | | 11/1997 | Hayashi | 272/DIG. 1 |

* cited by examiner

*Primary Examiner*—William J. Royer

(57) ABSTRACT

A container for storing a supply of toner particles therein is used in a developer unit of an electrophotographic printing machine. The container has a discharge port connected to a chamber storing the supply of toner therein. A movable member is positioned in the chamber of the container. The movable member includes a planar surface. When the planar surface is positioned remote from the discharge port, the planar surface receives toner particles. When the planar surface is positioned in engagement with the discharge port, toner particles are discharged from the planar surface through the discharge port. In this way, the member functions to seal the toner container when the toner container is in an non-operative position remote from the developer unit, and to meter precise quantities of toner particles to the developer roller of the developer unit when the toner container is in the developer unit in the operating mode thereof.

16 Claims, 3 Drawing Sheets

FIG. 2
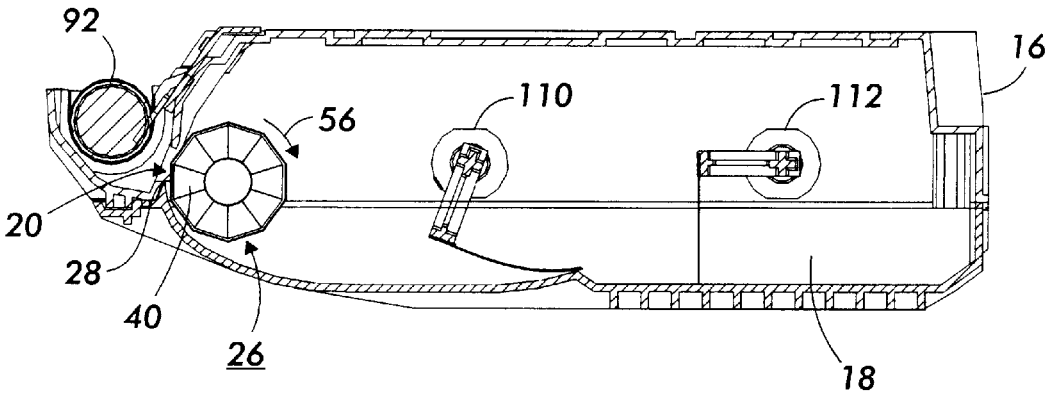
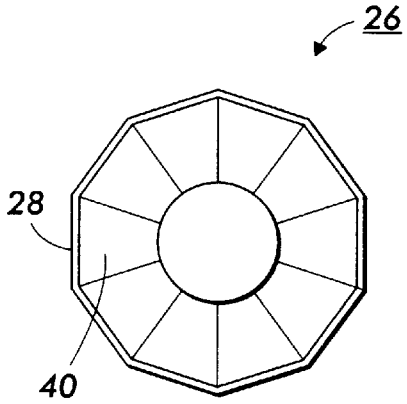
FIG. 3

TONER CARTRIDGE HAVING A PLANAR DISCHARGING MEMBER

This invention relates generally to an electrophotographic printing machine, and more particularly concerns a toner cartridge used in the developer unit of the printing machine.

An electrophotographic printing machine employs a photoconductive member that is charged to a substantially uniform potential so as to sensitive the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document. After the electrostatic latent image is recorded on the photoconductive member, the latent image is developed by bringing a developer material into contact therewith. Generally, the electrostatic latent image is developed with dry developer material comprising carrier granules having toner particles adhering triboelectrically thereto. Alternatively, a single component developer material such as toner particles may be employed. In addition, a liquid developer material may be used. The toner particles are attracted to the latent image forming a visible powder image on the photoconductive surface. After the electrostatic latent image is developed with the toner particles, the toner powder image is transferred to a sheet. Thereafter, the toner is heated to permanently fuse it to the sheet.

As successive electrostatic latent images are developed on the photoconductive surface, toner particles are depleted from the developer unit. Thus, it is necessary to furnish additional toner particles to the developer unit. It is highly desirable to maintain the ratio of carrier granules to toner particles within a prescribed boundary. This insures that the concentration of toner particles and carrier granules is maintained within limits so as to preclude the degradation of copy quality. A toner cartridge containing a supply of toner particles therein is associated with the developer unit of the printing machine. The toner cartridge, which may be readily inserted into the developer unit and removed therefrom by the machine operator, furnishes additional toner particles to the developer unit. It is highly desirable that this operation be a "white glove" operation. By that it is meant that no toner particles should spill on either the operator or on any of the machine components. Toner particles will contaminate the machine components resulting in a degradation in performance of the printing machine. In addition, toner particles will dirty the operator resulting in dissatisfaction in the performance of the printing machine. To accomplish this, it is necessary to seal the opening through which toner particles are discharged from the toner cartridge during handling thereof. This sealing arrangement must be readily removable from the toner cartridge opening to facilitate the discharge of toner particles when the toner cartridge is in the operative position in the developer unit. Over the years, various approaches have been developed for sealing and handling the toner cartridge in a "white glove" manner. Various types of toner cartridges have heretofore been employed. The following disclosures appear to be relevant:

U.S. Pat. No. 4,993,829
Patentee: Naganuma et al.
Issued: Feb. 19, 1991

U.S. Pat. No. 5,686,985

Patentee: Hayashi
Issued: Nov. 11, 1997

U.S. Pat. No. 4,993,829 disclosed a rotating member positioned in the opening through which toner material is discharged into the developer unit. The rotating member may be a sponge roller.

U.S. Pat. No. 5,686,985 describes a toner replenishment roller mounted in the shutter opening of the toner cartridge. This roller is a sponge roller with a sponge cover.

In accordance with one aspect of the features of the present invention, there is provided a container for storing a supply of toner therein. The container includes a housing having a dispensing port. The housing defines a chamber storing a supply of toner therein. A member having a planar surface is mounted movably in the chamber so that in a position remote from the dispensing port the planar surface receives toner and in a position in engagement with the dispensing port toner is discharged from the planar surface through the dispensing port.

Pursuant to another aspect of the present invention, there is provided a developer unit including a container defining a chamber for storing a supply of toner particles therein. The container has a dispensing port from which the particles exit the chamber. A member, having a planar surface, is mounted movable in the chamber so that in a position remote from the dispensing port, the planar surface receives particles and, in a position in engagement with the dispensing port, particles are discharged from the planar surface through the dispensing port. A developer roller, operatively associated with the member, receives particles being discharged from the dispensing report.

In still another aspect of the present invention, there is provided a printing machine of the type in which an electrostatic latent image recorded on a photoconductive member is developed with toner to form a developed image thereon that is transferred and fused to a sheet. The improvement includes a container defining a chamber for storing a supply of toner therein. The container has a dispensing port from which the toner exits the chamber. A member, having a planar surface, is mounted movably in the chamber so that in a position remote from the dispensing port, the planar surface receives toner and, in a position in engagement with the dispensing port, toner is discharged from the planar surface through the dispensing port. A developer roller, operatively associated with the member, receives toner being charged from the dispensing port. The developer roller is positioned adjacent the photoconductive member so that the electrostatic latent image recorded thereon attracts toner thereto to form the developed image on the photoconductive member.

Other aspects of the present invention will become apparent as the following description proceeds and upon reference to the drawings in which:

FIG. 2 is a schematic elevational view showing the developer unit of the FIG. 1 process cartridge;

FIG. 3 is a schematic elevational view showing the replenishment roller used in the toner cartridge of the FIG. 2 developer unit.

Figure 1:
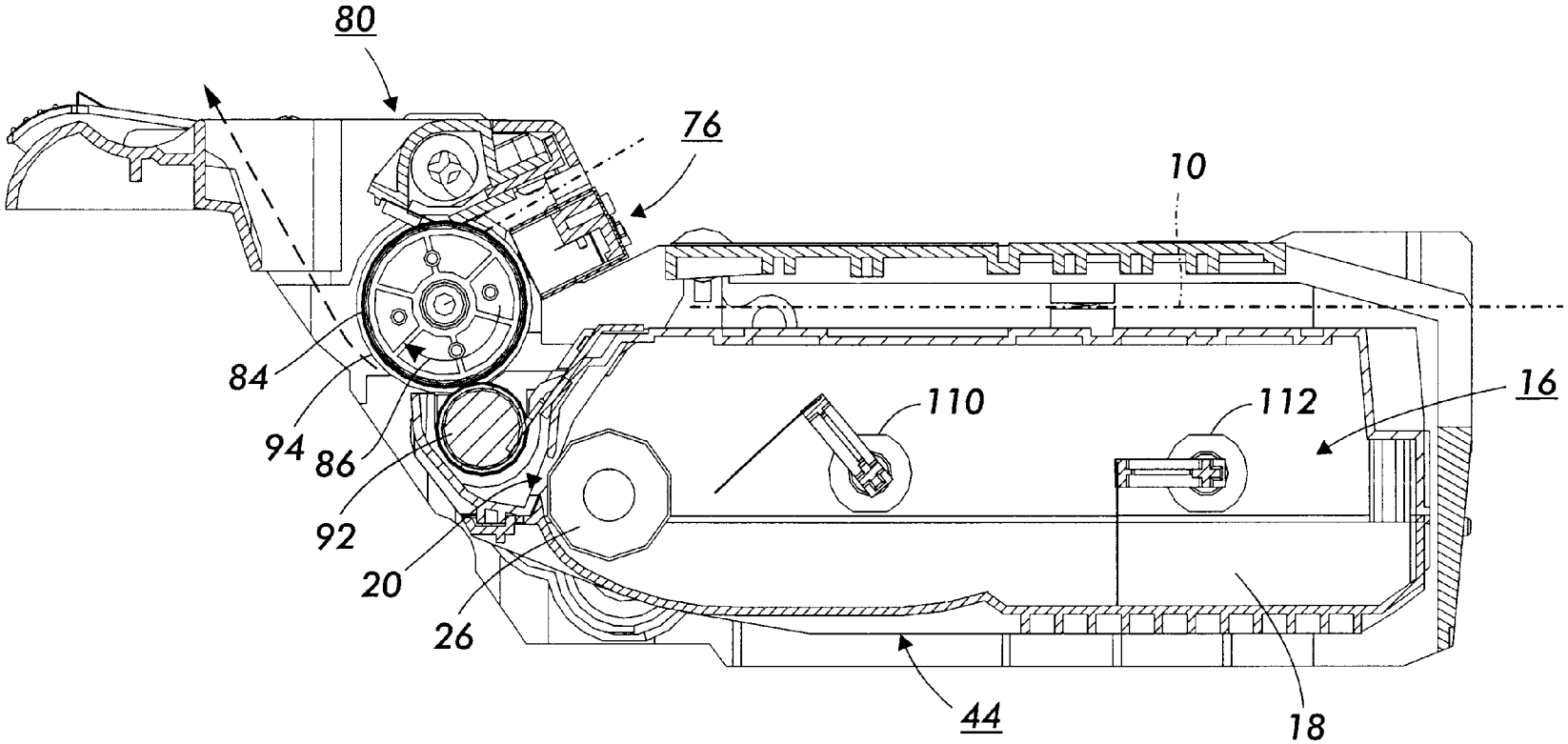
FIG. 1 is a schematic, elevational view showing a process cartridge module incorporating the present invention therein.

While the present invention will hereinafter be described in connection with a preferred embodiment, it will be understood that it is not intended to limit the invention to that embodiment. On the contrary, it is intended to cover all alternatives, modifications and equivalents that may be included within the spirit and scope of the invention as defined by the appended claims.

For a general understanding of the features of the present invention, reference is made to the drawings. In the drawings, like reference numerals have been used throughout to designate identical elements.

Figure 4:
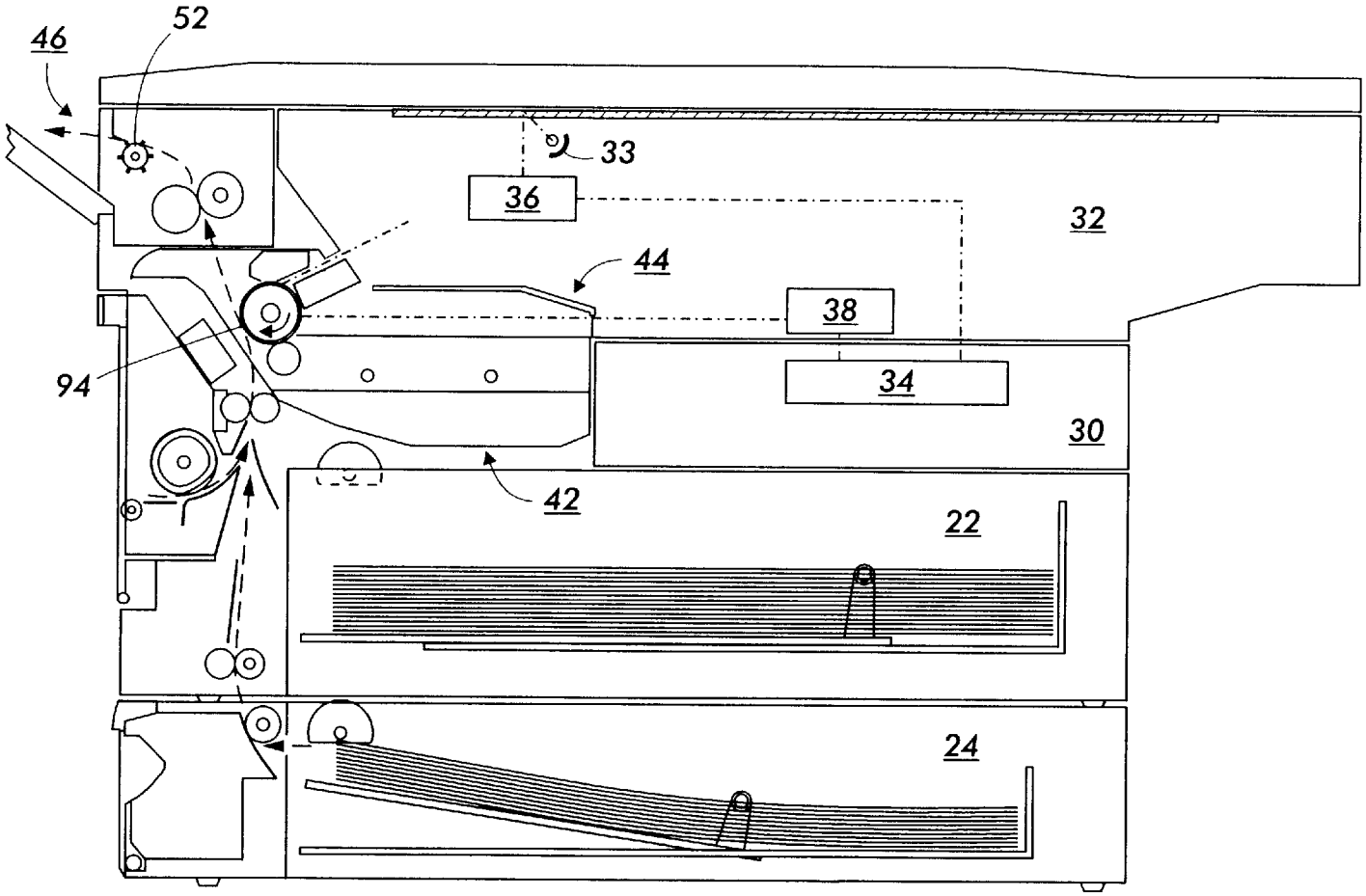
FIG. 4 is a schematic elevational view showing an electrophotographic printing machine incorporating the FIG. 1 process cartridge therein.

Referring now to FIG. 4, there is shown an electrophotographic printing machine incorporating the features of the present invention therein. The printing machine includes a copy sheet input module 22 and an auxiliary copy sheet input module 24. An electronic controller power supply module 30 is aligned adjacent copy sheet input module 22. A latent image forming module 32 is aligned against power supply module 30. Power supply module 30 includes all of the controls and power supplies for all of the modules and processes of the printing machine. It also includes an image processing pipeline unit 34 for managing and processing raw digitized images from a raster input scanner (RIS) 36 and generating process digitized images for a raster output scanner (ROS) 38. Image forming module 32 includes RIS 36, ROS 38 and light source 33. A customer replaceable unit, CRU or process cartridge module 44 is insertably and removably mounted within cavity 42 and is mutually aligned with and operatively connected to copy sheet input module 22 and auxiliary copy sheet input module 24. The details of CRU 44 will be discussed hereinafter with reference to FIGS. 1 –3, inclusive. A fuser module 46 is mounded above CRU 44 and adjacent an end of image forming module 32. Fuser module 46 includes a fuser roll and a backup roll. The backup roll is resiliently urged into engagement with the fuser roll to form a nip through which the sheet passes. In the fusing operation, the toner particles coalesce and bond to the sheet in image configuration forming a powder image thereon. After the finishing operation, exit roll 52 advances the sheet through and out of fuser module 46 into a catch tray.

Referring now to FIG. 1, CRU 44 includes a photoconductive drum 84 rotating in the direction of arrow 86. Initially, drum 84 rotates through charging station 76. Charging station 76 includes a corona-generating device which charges the photoconductive surface of drum 84 to a relatively high, substantially uniform potential.

After the photoconductive surface of drum 84 is charged, the charged portion thereof is advanced to an exposure station 10 where light rays from ROS 38 illuminate the charged portion of the photoconductive surface of drum 84 to record an electrostatic latent image thereon. Thereafter, drum 84 advances the electrostatic latent image to development station. At development station 12, developer roller 92 of CRU 44 deposits toner particles on the electrostatic latent image. After the toner powder image has been formed on the photoconductive surface of drum 84, drum 84 continues to rotate in the direction of arrow 86 to transfer station 94. At transfer station 94, a corona generating device sprays ions onto the backside of the sheet from copy sheet input module 22 or auxiliary copy sheet input module 24. This attracts the toner image from the photoconductive surface of drum 84 to the sheet of support material. As hereinbefore described with reference to FIG. 4, the sheet of support material is then advanced through fuser module 46 to catch tray for subsequent removal therefrom by the machine operator.

Invariably, after the sheet is separated from the photoconductive surface of drum 84, some residual particles remain adhering thereto. These residual particles are removed from the photoconductive surface at cleaning station 80. Cleaning station 80 includes a cleaning blade and a waste toner removal auger. The cleaning blade is in contact with the photoconductive surface of drum 84 to remove the residual particles adhering thereto.

Turning now to FIG. 1, CRU 44 includes developer roller or roll 92 and toner cartridge 16. Developer roller 92 includes a rotating sleeve having a magnet disposed interiorily thereof. The developer material is attracted by the magnet to the sleeve of developer roll 92. Toner cartridge 16 defines a chamber 18 storing a supply of toner particles therein. One end of toner cartridge 16 is opened to form dispensing or discharge port 20. A resilient, octagonal shaped roller 26 is positioned so that successive planar surfaces thereof seal dispensing port 20. Toner agitators 110 and 112 are disposed in chamber 18 of toner cartridge 16. Agitators 110 and 112 rotate so as to mix the toner particles in chamber 18. A further description of CRU 44 may be found in U.S. Pat. No. 5,809,377 issued Chiesa et al on Sep. 15, 1988, the relevant portions thereof being hereby incorporated into the present application.

Referring now to FIG. 2, there is shown toner cartridge 16 in greater detail. As depicted thereat, agitators 110 and 112 are positioned in chamber 18 and rotate to mix and disturb the toner particles therein. Dispensing roller 26 is an octagonal shaped roller having eight planar surfaces. Each planar surface has a surface area corresponding to the surface area of dispensing port 20. Roller 26 is made from a resilient material such as open-celled polyurethane. The roller 26 is positioned so that the planar surface presses against the dispensing port 20. This seals the dispensing port when the volume of the roller formed by the planar surface and the triangular segment thereof no longer have particles therein. For example, planar surface 28 forms triangular segment 40. When planar surface 28 and segment 40 are remote from discharge port 20, toner particles are received in the open-celled polyurethane material. As roller 26 rotates in the direction of arrow 56, planar surface 28 is positioned in engagement with dispensing port 20. In this position, the toner particles received in segment 40 are discharged through dispensing port 20 and received by developer roller 92. Thus, when toner cartridges are being shipped and dispensing roller 26 is stationary, planar surface 28 seals dispensing port 20 and prevents the discharge of toner particles therefrom. In operation, roller 26 rotates and segment 40 receives and temporarily stores toner particles therein, when remote from discharge port 20. As roller 26 continues to rotate in the direction of arrow 56, planar surface 28 engages discharge port 20 and the toner particles received by segment 40 are discharged through discharge port 20 to developer roller 92. The size of each triangular segment 40 is designed to carry enough toner to feed developer roller 92 a sufficient amount of toner particles to enable a number of prints to be made by the printing machine. Developer roller 92 is coupled to dispensing roller 26 by a gear train. The gear train is designed such that every six revolutions of the developer roller results in one revolution of toner agitators 110 and 112, and, similarly, one revolution of dispensing roller 26. Toner agitators 110 and 112 feed toner material to dispensing roller 26. Thus, roller 26 acts as a seal as well as metering a precise quantity of toner particles to developer roller 92.

Turning now to FIG. 3, there is shown dispensing roller 26. Dispensing roller 26 includes eight planar surfaces 28 and their corresponding segments 40. Roller 26 is made preferably from an open-celled urethane material and is adapted to receive toner particles in each segment 40 thereof. The volume of toner particles received in each segment 40 is sufficient to enable the developer unit to develop several electrostatic latent images with the toner particles. The toner particles in segment 40 are discharged through discharge port 20 when the respective planar surface 28 is in engagement therewith. Thus, it is clear that dispensing roller 26 functions in two capacities. In one capacity, it seals the discharge port preventing toner particles from escaping therefrom. This enables a "white glove" approach for the installation and removal of toner cartridge 16 from the developer unit of the printing machine. In addition, roller 26 meters precise quantities of toner particles to the developer roll during the operation of the printing machine enabling successive electrostatic latent images to be developed with the optimum amount of toner particles.

In recapitulation, it is clear that the container of the present invention stores a supply of particles for developing an electrostatic latent image recorded on a photoconductive drum. The container includes a resilient, octagonal shaped roller which seals the discharge port in the toner container, when the toner container is not in the printing machine. In addition, the dispensing roller meters precise quantities of toner particles to the developer roller of the developer unit when in the printing machine. This is achieved by using an octagonal shaped roller in which the surface area of each planar surface corresponds substantially to the surface area of the discharge port. The dispensing roller is coupled to the developer roller to rotate as a function of the rotation of the developer unit. This insures that the optimum amount of toner particles are delivered to the developer roller.

It is, therefore, apparent that there has been provided in accordance with the present invention, a toner container for use in a developer unit of an electrophotographic printing machine which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that may fall within the spirit and broad scope of the appended claims.

What is claimed is:

1. A container for storing a supply of toner therein, including:

a housing defining a chamber storing the toner therein and a discharge port connected thereto for discharging toner therefrom; and a member having a planar surface wherein the planar surface area is substantially equal to the discharge port surface area, said member being mounted moveably in the chamber so that in a position remote from the discharge port the planar surface receives toner and, in a position in engagement with the discharge port, toner is discharged from the planar surface through the discharge port.

2. A container according to claim 1, wherein said member includes a plurality of planar surfaces.

3. A container according to claim 2, wherein said member is octagonal shaped and is mounted rotatably to move successive planar surfaces into engagement with the discharge port.

4. A container according to claim 3, wherein said member includes a resilient material.

5. A developer unit, including:

a container defining a chamber for storing a supply of particles therein, said container having a discharge port connected to the chamber from which the particles exit the chamber, and a member having a planar surface wherein the planar surface area is substantially equal to the discharge port surface area, said member being mounted moveably in the chamber so that in a position remote from the discharge port the planar surface receives particles and in a position in engagement with the discharge port particles are discharged from the planar surface through the discharge port; and a developer roll, operatively associated with said member to receive particles being discharged from the discharge port.

6. A developer unit according to claim 5, wherein said member includes a plurality of planar surfaces.

7. A developer unit according to claim 6, wherein said member is octagonal shaped and mounted rotatably to move successive planar surfaces into engagement with the discharge port.

8. A developer unit according to claim 7, wherein said member includes a resilient material.

9. A developer unit according to claim 7, wherein said developer roll and said member are coupled to one another so that successive planar surfaces advance into engagement with the discharge port in response to said developer roll rotating a preselected number of revolutions.

10. A developer unit according to claim 9, further including a gear train coupling said developer roll with said member.

11. A printing machine of the type in which an electrostatic latent image recorded on a photoconductive member is developed with toner to form a developed image on the photoconductive member as transferred and fused to a sheet, wherein the improvement includes:

a container defining a chamber for storing a supply of toner therein, said container having a discharge port connected to the chamber from which the toner exits the chamber, and a member having a planar surface wherein the planar surface area is substantially equal to the discharge port surface area, said member being mounted moveable in the chamber so that, in a position remote from the discharge port, the planar surface receives toner, and, in a position in engagement with the discharge port, toner is discharged from the planar surface through the discharge port; and a developer roll, operatively associated with said member, to receive toner being discharged from the discharge port, said developer roll being positioned adjacent the photoconductive member so that the electrostatic latent image recorded thereon attracts toner thereto to form the developed image on the photoconductive member.

12. A printing machine according to claim 11, wherein said member includes a plurality of planar surfaces.

13. A printing machine according to claim 12, wherein said member is octagonal shaped and mounted rotatably to move successive planar surfaces into engagement with the discharge port.

14. A printing machine according to claim 13, wherein said member includes a resilient material.

15. A printing machine according to claim 13, wherein said developer roll and said member are coupled to one another so that successive planar surfaces advance into engagement with the discharge port in response to said developer roll rotating a preselected number of revolutions.

16. A printing machine according to claim 15, further including a gear train coupling said developer roll with said member.

* * * * *